US008382603B1

(12) United States Patent
Hong

(10) Patent No.: US 8,382,603 B1
(45) Date of Patent: Feb. 26, 2013

(54) GOLF PUTTER HAVING A TRAINING STRIKE PLATE

(76) Inventor: Benedict P. Hong, Garden Grove, CA (US)

( * ) Notice: Subject to any disclaimer, the term of this patent is extended or adjusted under 35 U.S.C. 154(b) by 64 days.

(21) Appl. No.: 12/944,532

(22) Filed: Nov. 11, 2010

(51) Int. Cl.
*A63B 69/36* (2006.01)

(52) U.S. Cl. ..... 473/226; 473/236; 473/251

(58) Field of Classification Search ..... 473/219–256; D21/759
See application file for complete search history.

(56) References Cited

U.S. PATENT DOCUMENTS

| | | | | | |
|---|---|---|---|---|---|
| 2,503,506 | A | * | 4/1950 | Miller | 473/251 |
| 3,489,415 | A | * | 1/1970 | Smith | 473/236 |
| 3,989,256 | A | * | 11/1976 | Cicero | 473/252 |
| 4,323,246 | A | * | 4/1982 | Nehrbas, Jr. | 473/236 |
| 4,422,638 | A | * | 12/1983 | Tucker | 473/329 |
| 5,062,639 | A | * | 11/1991 | Hitt | 473/335 |
| 5,135,228 | A | * | 8/1992 | Hawkins et al. | 473/236 |
| D353,178 | S | * | 12/1994 | Koleoglou | D21/759 |
| 5,437,447 | A | | 8/1995 | Rigutto | |
| 5,445,386 | A | * | 8/1995 | Marshall | 473/251 |
| 5,542,675 | A | * | 8/1996 | Micciche et al. | 473/329 |
| 5,921,871 | A | | 7/1999 | Fisher | |
| 6,238,303 | B1 | | 5/2001 | Fite | |
| 6,270,423 | B1 | * | 8/2001 | Webb | 473/226 |
| 6,273,827 | B1 | * | 8/2001 | Hockerson et al. | 473/236 |
| 6,296,574 | B1 | * | 10/2001 | Kaldis | 473/236 |
| D459,422 | S | | 6/2002 | Fisher | |
| 6,780,119 | B1 | * | 8/2004 | Gankas | 473/236 |
| 7,086,961 | B2 | | 8/2006 | Wright et al. | |
| 7,163,465 | B2 | | 1/2007 | Edel | |
| 7,341,527 | B1 | | 3/2008 | Fisher | |
| 7,416,494 | B2 | | 8/2008 | Edel | |
| 7,442,129 | B2 | | 10/2008 | Bardha | |
| D583,888 | S | * | 12/2008 | Nehrbas | D21/759 |
| 2002/0072430 | A1 | | 6/2002 | Bullock et al. | |
| 2002/0177486 | A1 | * | 11/2002 | Lazier et al. | 473/236 |
| 2003/0134686 | A1 | * | 7/2003 | Arkley et al. | 473/236 |
| 2004/0147332 | A1 | * | 7/2004 | Engdahl | 473/236 |
| 2006/0135278 | A1 | * | 6/2006 | Lee | 473/236 |

* cited by examiner

*Primary Examiner* — Sebastiano Passaniti

(57) ABSTRACT

A golf putter is provided having a training strike plate for training a user to consistently strike a golf ball at an optimal point on the putter face while putting. The golf putter has a club head. A training strike plate is selectively couplable to the club head. The training strike plate has a protrusion that extends from a face of the club head when the training strike plate is coupled to the club head. The protrusion has an elongated narrow face such that the protrusion is designed for driving a golf ball away from the protrusion at an acute angle relative to the face of the club head when the golf ball is contacted by an edge of the face of the protrusion.

11 Claims, 4 Drawing Sheets

GOLF PUTTER HAVING A TRAINING STRIKE PLATE

BACKGROUND OF THE DISCLOSURE

Field of the Disclosure

The disclosure relates to golf putting devices and more particularly pertains to a new golf putting device for training a user to consistently strike a golf ball at an optimal point on the putter face while putting.

SUMMARY OF THE DISCLOSURE

An embodiment of the disclosure meets the needs presented above by generally comprising a golf club having a club head. A training strike plate is selectively couplable to the club head. The training strike plate has a protrusion that extends from a face of the club head when the training strike plate is coupled to the club head. The protrusion has an elongated narrow face such that the protrusion is designed for driving a golf ball away from the protrusion at an acute angle relative to the face of the club head when the golf ball is contacted by an edge of the face of the protrusion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
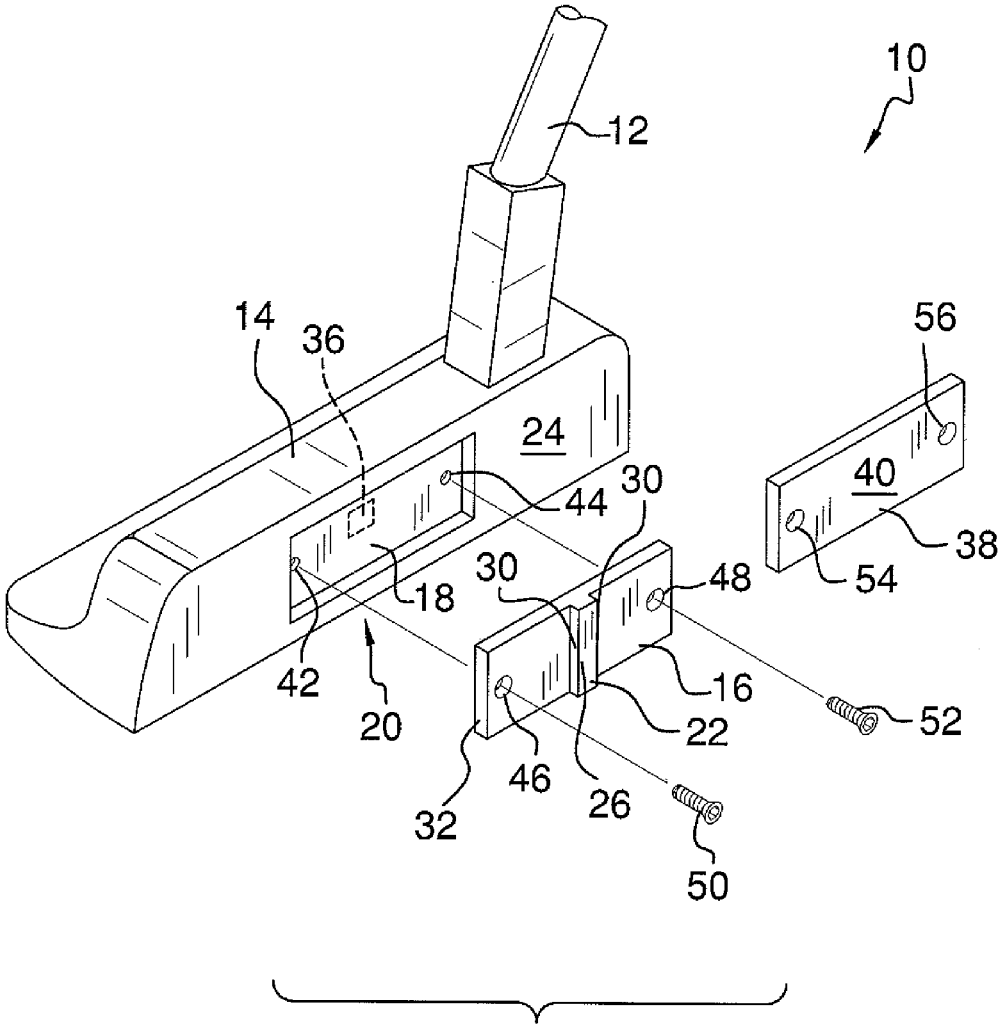
FIG. 1 is a front top side exploded perspective view of a golf putter having a training strike plate according to an embodiment of the disclosure.
Figure 2:
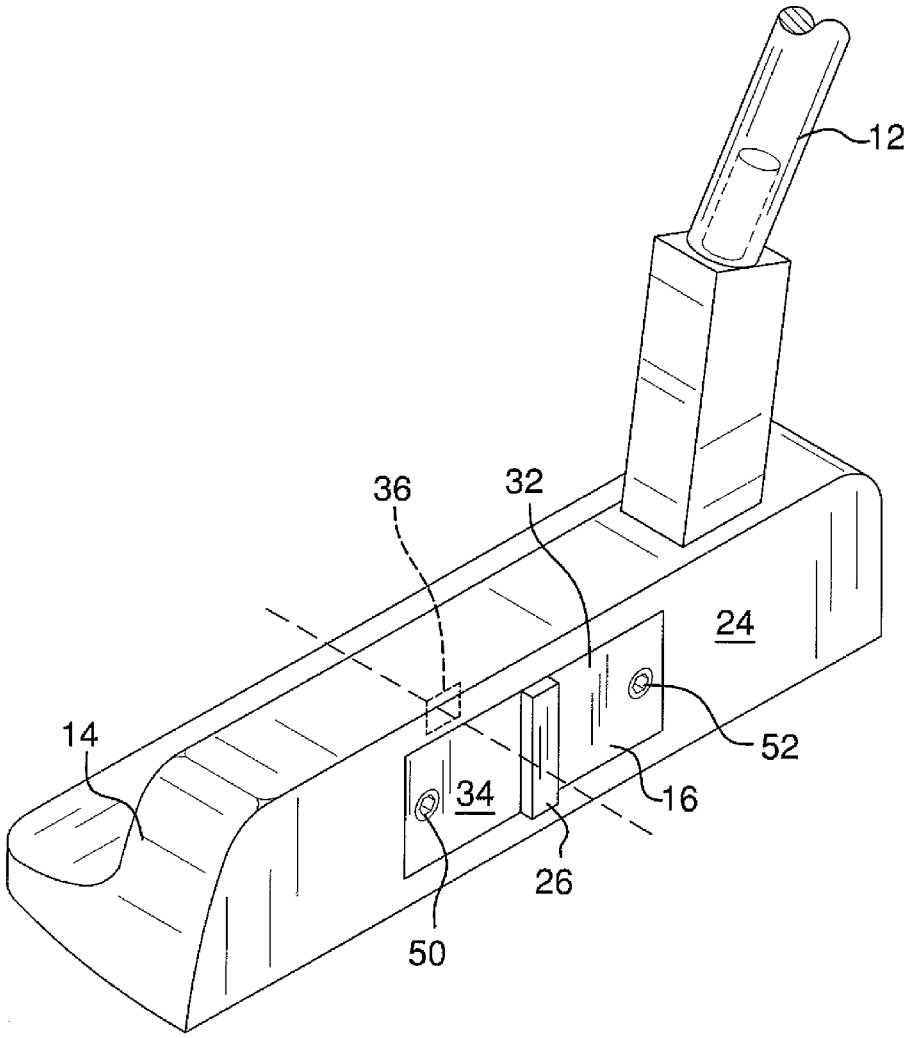
FIG. 2 is a front top side perspective view of an embodiment of the disclosure.
Figure 4:
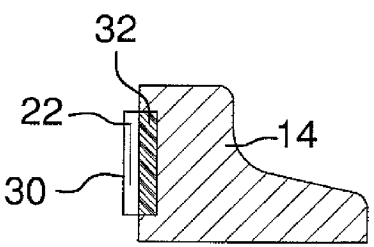
FIG. 4 is a cross-sectional view of an embodiment of the disclosure taken along line 4-4 of FIG. 3.
Figure 3:
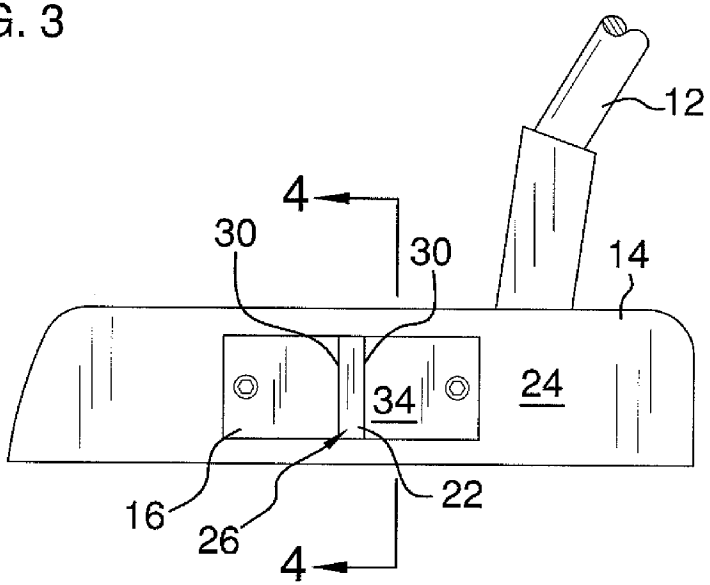
FIG. 3 is a front view of an embodiment of the disclosure.

With reference now to the drawings, and in particular to FIGS. 1 through 7 thereof, a new golf putting device embodying the principles and concepts of an embodiment of the disclosure and generally designated by the reference numeral 10 will be described.

As best illustrated in FIGS. 1 through 7, the golf putter having a training strike plate 10 generally comprises a golf club 12 having a club head 14. A training strike plate 16 is selectively couplable to the club head 14. A recess 18 is positioned in a central section 20 in the club head 14. The training strike plate 16 is positionable in the recess 18. The training strike plate 16 has a protrusion 22 that extends from a face 24 of the club head 14 when the training strike plate 16 is coupled to the club head 14. The protrusion 22 has an elongated narrow face 26 such that the protrusion 22 is designed for driving a golf ball 28 away from the protrusion 22 at an acute angle relative to the face 24 of the club head 14 when the golf ball 28 is contacted by an edge 30 of the face 26 of the protrusion 16.

The protrusion 22 extends from a main body portion 32 of the training strike plate 16. The main body portion 32 has a continuous transverse rectangular cross-section extending along a length of the main body portion 32. A forward face 34 of the main body portion 32 of the training strike plate 16 is coplanar with the face 24 of the club head 14 when the training strike plate 16 is coupled to the club head 14. The protrusion 22 has a continuous rectangular transverse cross-sectional shape along a height of the protrusion 22. The protrusion 22 is aligned with a center of gravity 36 of the club head 14 when the training strike plate 16 is coupled to the club head 14. Thus, the protrusion 22 defines the optimal striking point when using the putter 12.

A playing strike plate 38 may also be selected and coupled to the club head 14. The playing strike plate 38 has a smooth planar playing face 40. The playing strike plate 38 is positionable in the recess 18 such that the playing face 40 is co-planar with the face 24 of the club head 14 when the playing strike plate 38 is coupled to the club head 14. Thus, the putter 12 may be used for both practice and during an actual game of golf.

A pair of connection apertures 42,44 are positioned in the recess 18 of the club head 14. A pair of holes 46,48 is positioned in the training strike plate 16. The holes 46,48 are alignable with the pair of connection apertures 42,44. A pair of connectors 50,52 are insertable through the holes 46,48 and couplable to the connection apertures 42,44 such that the training strike plate 16 is secured to the club head 14. The connectors 50,52 are recessed into the holes 46,48 in the training strike plate 16 when the connectors 50,52 are coupled to the connection apertures 42,44.

Similarly, a pair of openings 54,56 are positioned in the playing strike plate 38. The openings 54,56 are alignable with the pair of connection apertures 42,44. The pair of connectors 50,52 are insertable through the openings 54,56 and couplable to the connection apertures 42,44 such that the playing strike plate 38 is secured to the club head 14. The connectors 50,52 are recessed into the openings 54,56 in the playing strike plate 38 when the connectors 50,52 are coupled to the connection apertures 42,44. The connectors 50,52 may also be spaced sufficiently apart that they would not interfere with the optimal striking area of the putter 12. Various other striking plates or inserts constructed of various materials may be interchangeably coupled to the club head 14 as desired to alter the characteristics of the putter 12 during use.

Figure 5:
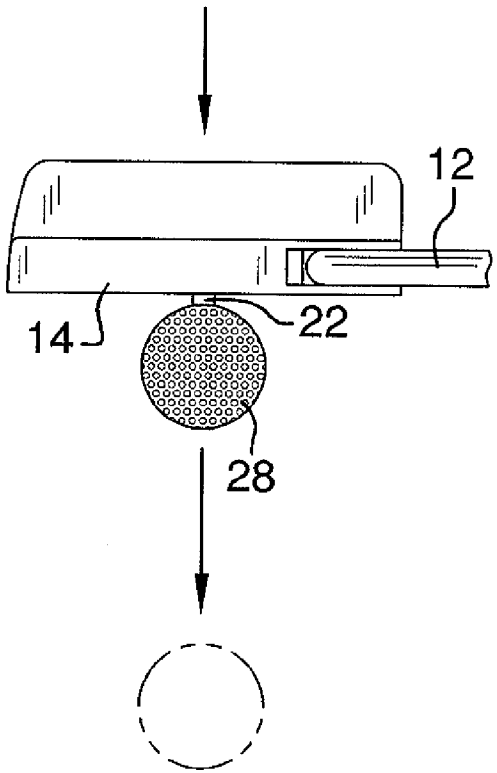
FIG. 5 is a top view of an embodiment of the disclosure.
Figure 6:
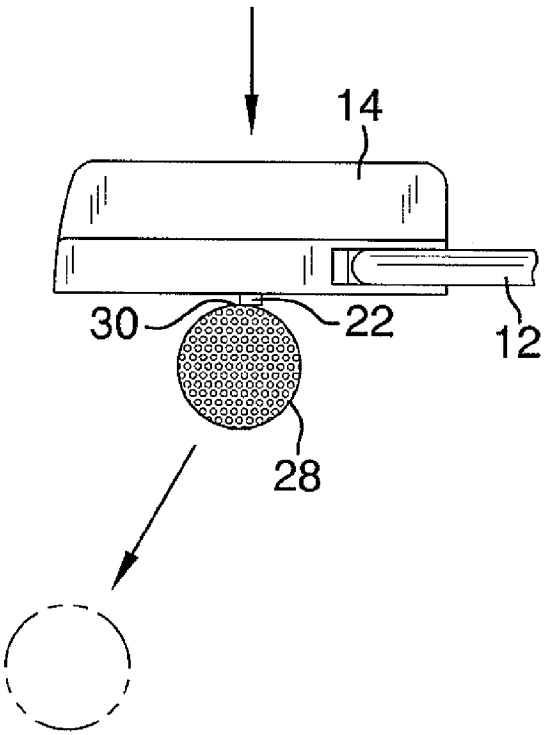
FIG. 6 is a top view of an embodiment of the disclosure.
Figure 7:
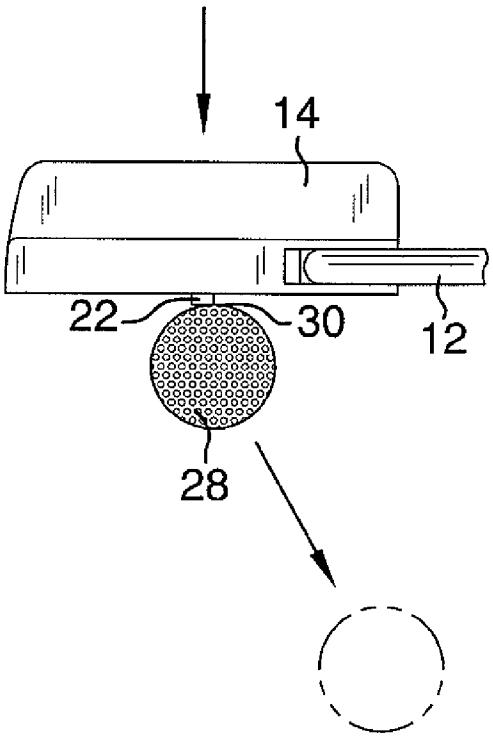
FIG. 7 is a top view of an embodiment of the disclosure.

In use, the training strike plate 18 is used during practice. The narrowness of the protrusion 22 provides minimal surface area to provide a straight putt as shown in FIG. 5. As shown in FIGS. 6 and 7, when the golf ball 28 contacts the edge 30 of the face 26 of the protrusion 22, the user receives quick visible feedback as the golf ball 28 is driven at an acute angle to the club head 14. Repetition enhances the ability of the user to consistently strike the golf ball square on the face 26 of the protrusion 22. This conditions the user and enhances the ability of the user to strike the optimal point of impact on the club head 14 when the playing striking plate 38 is inserted into the recess 18 and secured to the club head 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A golf putter assembly comprising:

a golf club having a club head;

a training strike plate selectively couplable to said club head;

said training strike plate having a protrusion, said protrusion extending from a face of said club head when said training strike plate is coupled to said club head;

said club head having a recess therein;

said training strike plate being positionable in said recess;

wherein said protrusion has an elongated narrow face whereby said protrusion is adapted for driving a golf ball away from said protrusion at an acute angle relative to said face of said club head when the golf ball is contacted by an edge of said face of said protrusion, a height dimension being defined extending from an upper edge to a lower edge of said elongated narrow face, a width dimension being defined extending from a first lateral edge to a second lateral edge of said elongated narrow face, said elongated narrow face being elongated from said upper edge to said lower edge such that said height dimension is greater than said width dimension, said protrusion having a longitudinal axis extending through said upper and lower edges being oriented perpendicular to a longitudinal axis of said training strike plate;

a playing strike plate couplable to said club head, said playing strike plate having a smooth planar playing face; and said playing strike plate being positionable in said recess such that said playing face is co-planar with said face of said club head when said playing strike plate is coupled to said club head.

2. The assembly of claim 1, wherein said protrusion is aligned with a center of gravity of said club head when said training strike plate is coupled to said club head.

3. The assembly of claim 1, further including a playing strike plate selectively couplable to said club head, said playing strike plate having a smooth planar face.

4. The assembly of claim 1, further comprising:

a pair of connection apertures positioned in said recess of said club head;

a pair of holes in said training strike plate, said pair of holes being alignable with said pair of connection apertures; and a pair of connectors insertable through said holes and couplable to said connection apertures such that said training strike plate is secured to said club head.

5. The assembly of claim 4, wherein said connectors are recessed into said holes in said training strike plate when said connectors are coupled to said connection apertures.

6. The assembly of claim 1, further comprising:

a pair of connection apertures positioned in said recess of said club head;

a pair of openings in said playing strike plate, said pair of openings being alignable with said pair of connection apertures; and a pair of connectors insertable through said openings and couplable to said connection apertures such that said playing strike plate is secured to said club head.

7. The assembly of claim 6, wherein said connectors are recessed into said openings in said playing strike plate when said connectors are coupled to said connection apertures.

8. The assembly of claim 1, wherein said protrusion extends from a main body portion of said training strike plate, said main body portion having a continuous transverse rectangular cross-section extending along a length of said main body portion.

9. The assembly of claim 8, wherein a forward face of said main body portion of said training strike plate is coplanar with said face of said club head when said training strike plate is coupled to said club head.

10. The assembly of claim 1, wherein said protrusion has a continuous rectangular transverse cross-sectional shape along a height of said protrusion.

11. A golf putter assembly comprising:

a golf club having a club head;

a training strike plate selectively couplable to said club head;

a recess in said club head;

said training strike plate being positionable in said recess;

said training strike plate having a protrusion, said protrusion extending from a face of said club head when said training strike plate is coupled to said club head;

wherein said protrusion has an elongated narrow face such that said protrusion is adapted for driving a golf ball away from said protrusion at an acute angle relative to said face of said club head when the golf ball is contacted by an edge of said face of said protrusion;

wherein said protrusion extends from a main body portion of said training strike plate, said main body portion having a continuous transverse rectangular cross-section extending along a length of said main body portion;

wherein a forward face of said main body portion of said training strike plate is coplanar with said face of said club head when said training strike plate is coupled to said club head;

wherein said protrusion has a continuous rectangular transverse cross-sectional shape along a height of said protrusion;

wherein said protrusion is aligned with a center of gravity of said club head when said training strike plate is coupled to said club head;

a playing strike plate selectively couplable to said club head, said playing strike plate having a smooth planar face;

said playing strike plate being positionable in said recess such that said playing face is co-planar with said face of said club head when said playing strike plate is coupled to said club head;

a pair of connection apertures positioned in said recess of said club head;

a pair of holes in said training strike plate, said pair of holes being alignable with said pair of connection apertures;

a pair of connectors insertable through said holes and couplable to said connection apertures such that said training strike plate is secured to said club head;

wherein said connectors are recessed into said holes in said training strike plate when said connectors are coupled to said connection apertures;

a pair of openings in said playing strike plate, said pair of openings being alignable with said pair of connection apertures;

said pair of connectors being insertable through said openings and couplable to said connection apertures such that said playing strike plate is secured to said club head; and wherein said connectors are recessed into said openings in said playing strike plate when said connectors are coupled to said connection apertures.

* * * * *